US009393476B2

(12) United States Patent
Arena et al.

(10) Patent No.: US 9,393,476 B2
(45) Date of Patent: Jul. 19, 2016

(54) TACKLING TRAINING DEVICE AND METHOD

(71) Applicant: Rogers Athletic Company, Inc., Clare, MI (US)

(72) Inventors: Anthony Arena, Schiller Park, IL (US); Kyle R. Camp, Clare, MI (US); Zachary John Reger, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 50 days.

(21) Appl. No.: 14/205,805

(22) Filed: Mar. 12, 2014

(65) Prior Publication Data

US 2015/0258408 A1 Sep. 17, 2015

(51) Int. Cl.

| | |
|---|---|
| ***A63B 69/34*** | (2006.01) |
| *A63B 69/00* | (2006.01) |
| *A63B 59/00* | (2015.01) |

(52) U.S. Cl.

CPC ..... *A63B 69/345* (2013.01); *A63B 59/00* (2013.01); *A63B 69/002* (2013.01); *A63B 69/0002* (2013.01); *A63B 69/34* (2013.01); *A63B 2243/007* (2013.01)

(58) Field of Classification Search

CPC ..... A63B 69/004; A63B 69/24; A63B 71/06; A63B 69/34; A63B 69/345; A63B 67/00; A63B 69/26; A63B 71/081; A63B 69/20

USPC ..... 473/442–445, 438, 422; D21/787, 788; 482/83, 86, 88

See application file for complete search history.

(56) References Cited

U.S. PATENT DOCUMENTS

| | | | | | |
|---|---|---|---|---|---|
| D169,243 | S * | 4/1953 | Doherty | D21/787 | |
| 2,904,337 | A * | 9/1959 | Canning | A63B 69/345 | 473/444 |
| 3,396,969 | A * | 8/1968 | Rosenfeld | A63B 69/345 | 473/444 |
| 3,759,515 | A * | 9/1973 | Crooks | A63B 67/00 | 473/444 |
| 3,972,526 | A * | 8/1976 | Cox, Jr. | A63B 67/00 | 273/458 |
| 4,201,379 | A * | 5/1980 | Williams | A63B 69/004 | 482/83 |
| 4,546,966 | A * | 10/1985 | Segura | A63B 69/26 | 482/86 |
| 5,501,649 | A * | 3/1996 | Queppet | A63B 69/004 | 482/86 |
| 6,302,831 | B1 * | 10/2001 | Henry | A63B 69/004 | 482/83 |
| 7,056,238 | B1 * | 6/2006 | Brown | A63B 69/345 | 473/422 |
| D678,444 | S * | 3/2013 | Jordan | D21/788 | |
| 9,017,227 | B1 * | 4/2015 | Vargas | A63B 69/34 | 482/83 |
| 9,039,584 | B2 * | 5/2015 | Chiang | A63B 69/004 | 482/83 |
| 2008/0008984 | A1 * | 1/2008 | McDonald | A63B 69/004 | 434/247 |
| 2014/0066266 | A1 * | 3/2014 | Chang | A63B 69/34 | 482/83 |
| 2015/0258408 | A1 * | 9/2015 | Arena | A63B 69/345 | 473/444 |

* cited by examiner

*Primary Examiner* — Mitra Aryanpour

(74) *Attorney, Agent, or Firm* — Carlson, Gaskey & Olds. P.C.

(57) ABSTRACT

An example tackling training device includes a primary pad, and at least one arm directing portion providing an aperture to receive an arm of a tackler.

16 Claims, 4 Drawing Sheets

TACKLING TRAINING DEVICE AND METHOD

BACKGROUND

This disclosure relates to sports equipment and, more particularly, to a device for training tackling techniques.

Tackling is part of many sports, including football. Improper tackling can cause injuries. Using proper tackling technique can desirably lessen injury risks.

Various types of training equipment have been developed to allow players to practice tackling techniques without facing off against another live player. What is considered proper tackling technique is continually refined.

SUMMARY

A tackling training device according to an exemplary aspect of the present disclosure includes, among other things, a primary pad, and at least one arm directing portion providing an aperture to receive an arm of a tackler.

In another example of the foregoing tackling training device, the at least one arm directing portion comprises a first arm directing portion on a first lateral side of the primary pad and a second arm directing portion on an opposing, second lateral side of the primary pad.

In another example of any of the foregoing tackling training devices, the device includes a head directing portion at a vertical upper portion of the primary pad. The head directing portion projects from the primary pad toward the tackler.

In another example of any of the foregoing tackling training devices, the head directing portion tapers from an apex to a laterally enlarged base. The apex is configured to be positioned closer to the tackler than the laterally enlarged base.

In another example of any of the foregoing tackling training devices, the apex is at a center of the primary pad.

In another example of any of the foregoing tackling training devices, the at least one aperture has a rectangular profile defined by padded portions about a perimeter of the rectangular profile.

In another example of any of the foregoing tackling training devices, the at least one aperture has a height and a width. The height is greater than the width.

In another example of any of the foregoing tackling training devices, the primary pad includes a first side laterally spaced from a second side. A first arm directing portion extends laterally outward from the first side and a second arm directing portion extends laterally outward from the second side.

In another example of any of the foregoing tackling training devices, the primary pad has a rectangular profile.

In another example of any of the foregoing tackling training devices, the primary pad is configured to be supported by a sled.

In another example of any of the foregoing tackling training devices, the primary pad is configured to be hand-held.

A method of training a tackler according to an exemplary aspect of the present disclosure includes, among other things, contacting a training tackler with a primary pad, and receiving at least an arm of the training tackler within an aperture of an arm directing portion during the contacting. The arm directing portion is connected to the primary pad.

In another example of the foregoing method, the method includes directing a head of the training tackler laterally during the contacting with a head directing portion projecting from the primary pad toward the training tackler.

In another example of any of the foregoing methods, the head directing portion tapers from an apex to a laterally enlarged base. The laterally enlarged base is positioned closer to the primary pad than the apex.

In another example of any of the foregoing methods, the method includes both arms of the training tackler within respective apertures at lateral sides of the primary pad during the tackling.

In another example of any of the foregoing methods, the method includes hand holding the pad during the contacting.

In another example of any of the foregoing methods, the method includes supporting the pad with a sled during the contacting.

In another example of any of the foregoing methods, the receiving includes receiving an upper arm portion of the training tackler during the contacting.

In another example of any of the foregoing methods, the receiving includes inserting at least an arm of the training tackler through the aperture, such that a portion of the at least one arm extends through and past the arm directing portion.

In another example of any of the foregoing methods, the aperture is a hole.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
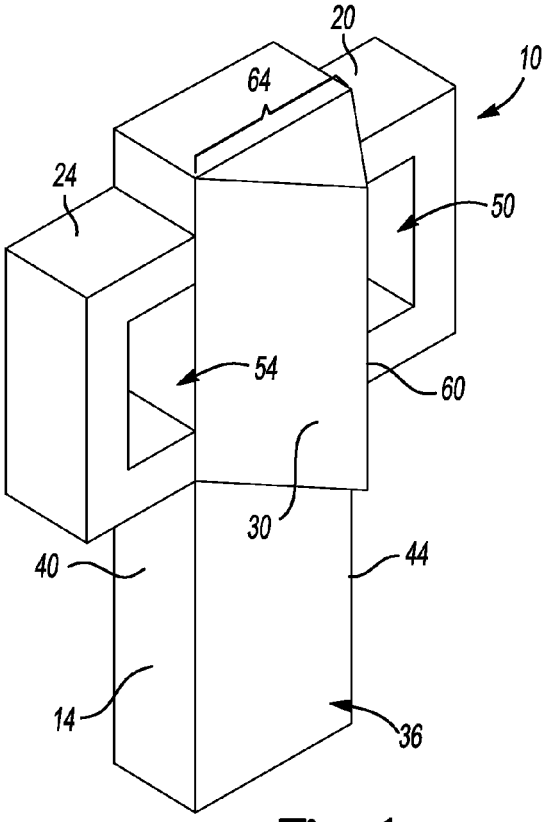
FIG. 1 illustrates a perspective view of an example tackling training device.
Figure 2:
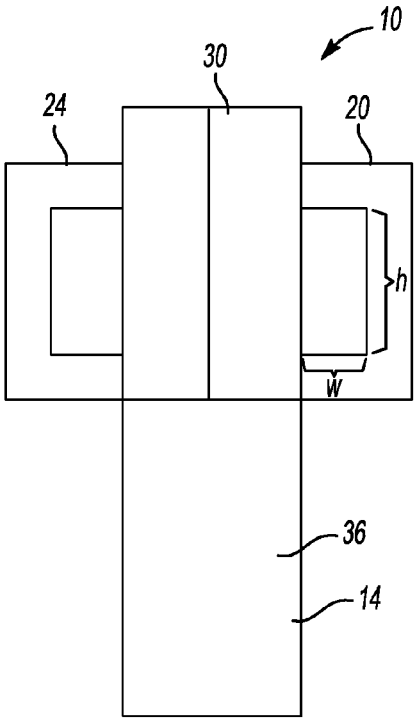
FIG. 2 illustrates a front view of the tackling training device of FIG. 1.
Figure 3:
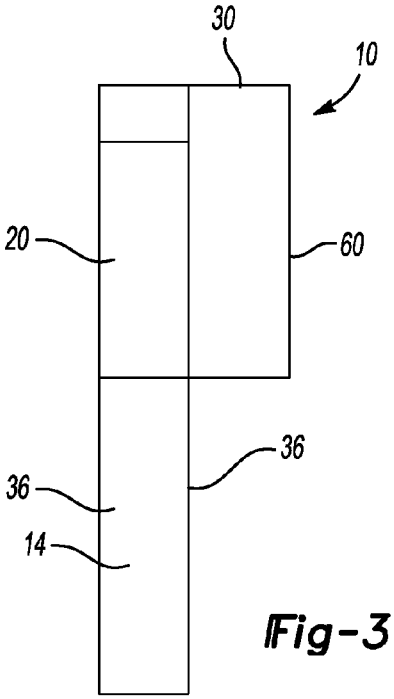
FIG. 3 illustrates a side view of the tackling training device of FIG. 1.
Figure 4:
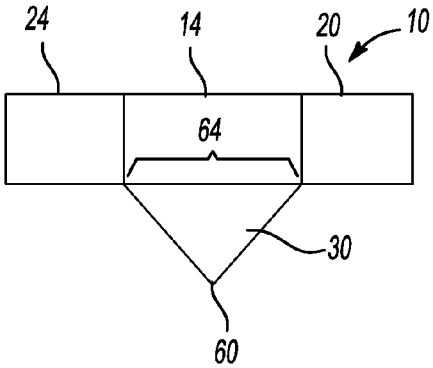
FIG. 4 illustrates a top view of the tackling training device of FIG. 4.

Referring to FIGS. 1-4, an example tackling training device 10 has a generally T-shaped configuration. The training device 10 includes a primary pad 14, a first arm directing portion 20, a second arm directing portion 24, and a head directing portion 30.

A forward facing area 36 of the primary pad 14 is vertically below the head directing portion 30. The head directing portion 30 extends forward from the primary pad 14, such that the forward facing area 36 is recessed relative to the head directing portion 30.

The arm directing portions 20 and 24 extend laterally outward from opposing lateral sides 40 and 44 of the primary pad 14. The arm directing portions 20 and 24 are connected to the primary pad 14 vertically above the forward facing area 36. The arm directing portions 20 and 24 may partially or fully connect to the head directing portion 30 in some examples.

The primary pad 14 has a generally rectangular cross sectional profile. The lateral sides 40 and 44 provide opposing sides of the rectangular profile. The forward facing area 36 completes another side of the rectangular profile.

The training device 10 includes two of the arm directing portions 20 and 24. In another example, one, or some other number of arm directing portions, may be used.

The arm directing portion 20 provides an aperture 50. The arm directing portion 24 also provides an aperture 54. The apertures 50 and 54 are rectangular. The apertures 50 and 54 have a height h and a width w. In this example, the height h is greater than the width w. The height h is about twice the width w in this example.

The example apertures 50 and 54 are holes having their entire perimeter p defined by a portion of the training device 10. In another example, the apertures 50 and 54 are slots having only a portion of their perimeter p defined by the training device 10. For example, the laterally outermost portions of the arm directing portions 20 and 24 could be eliminated to provide a slot rather than the holes 50 and 54.

The head directing portion 30 has a generally triangular profile p'. The head directing portion 30 extends from an apex 60 of the head directing portion 30 to a laterally enlarged base 64. The apex 60 faces away from the primary pad 14.

The laterally enlarged base 64 is thus closer to the primary pad 14 than the apex 60. Some of the head directing portion 30 extends vertically above the apertures 50 and 54. Some of the head directing portion 30 extends vertically above the arm directing portions 20 and 24.

Figure 5:
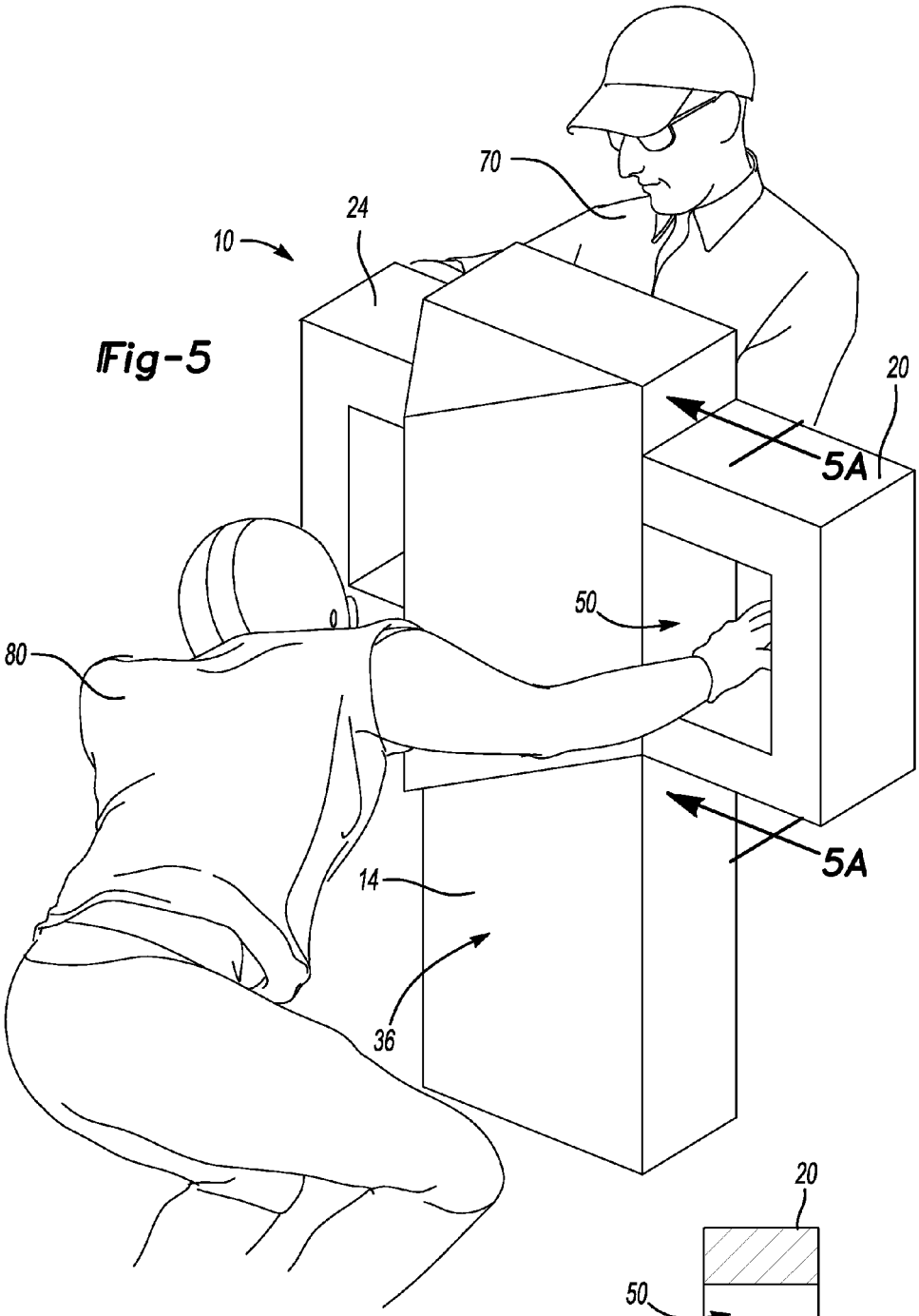
FIG. 5 illustrates a training tackler during an initial stage of a training exercise using the tackling training device of FIG. 1.
Figure 5A:
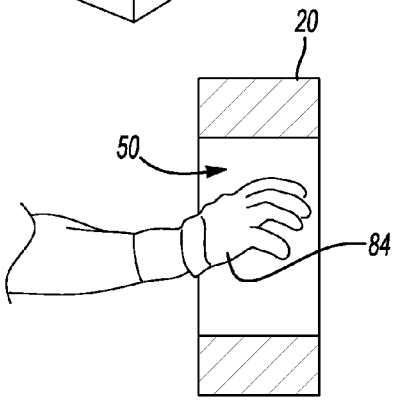
FIG. 5A shows a section view at line 5A-5A in FIG. 5.
Figure 6:
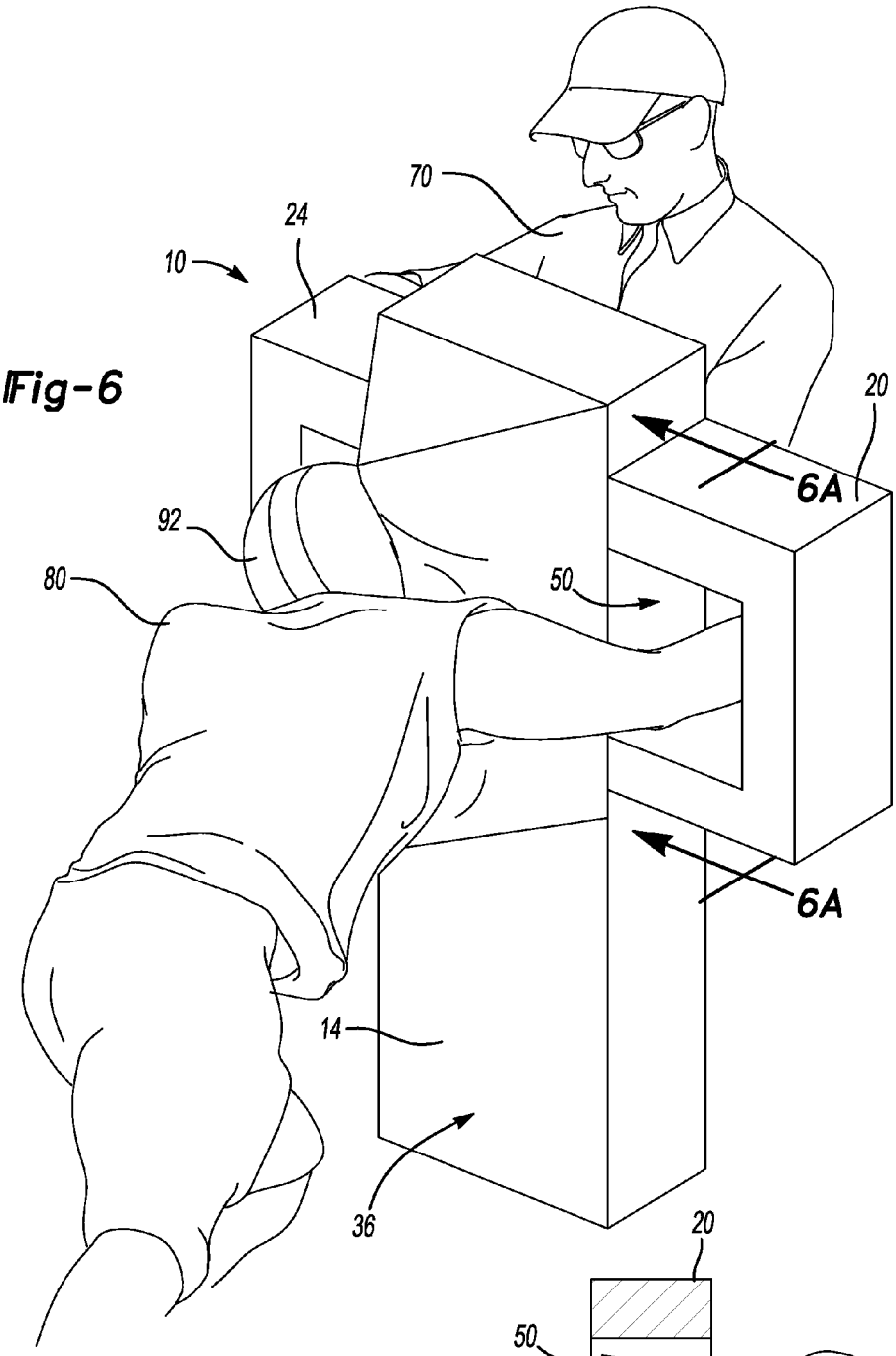
FIG. 6 illustrates a perspective view of a training tackler during a later stage of a training exercise using the tackling training device of FIG. 1.
Figure 6A:
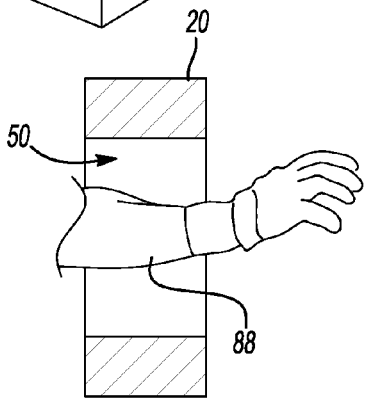
FIG. 6A shows a section view at line 6A-6A in FIG. 6.

Referring now to FIGS. 5-6A, during a training exercise, the training device 10 may be held by a coach or trainer 70. Hand holds (not shown) on the training device 10 may be engaged by the hands of the coach 70 to support the training device 10. In another example, the training device 10 is supported by a sled through an arm rather than a coach 70. In addition to being supported by hand or a sled, the training device 10 could be supported by some other way or placed directly on the ground.

An athlete 80 utilizes the training device 10 during training. The training device 10 trains the athlete 80 to utilize a desired tackling technique when tackling another athlete during a game or practice. In this example, the desired tackling technique calls for the athlete 80 to maintain an inside hand position during a tackle and to move their head to a side during a tackle. Desired tackling technique also calls for the athlete 80 to wrap up the other athlete. The athlete 80 may practice tackling multiple times using the training device 10 in place of another athlete.

During a practice tackle of the training device, the arm directing portions 20 and 24 help train the athlete 80 to maintain an inside hand position rather than wrapping wide and extending the tackler's hands 80 laterally outward. During the tackling training, the tackler's hands 84 move through the apertures 50 and 54. If the tackler's hands 84 do not move through the apertures 50 and 54, the athlete 80 will not be able to wrap the primary pad 14.

When starting a properly executed practice tackle, the hands 84 enter the apertures 50 and 54. During the latter stages of the practice tackle (see FIG. 6), the tackler's hands 84 move through and past the apertures 50 and 54 such that a portion of the tackler's arm 88, and perhaps the tackler's upper arm, are positioned within the apertures 50 and 54. Extending the hands 84 and arm 88 through the apertures 50 and 54 enables the athlete 80 to wrap the primary pad 14. The apertures 50 and 54 are also positioned at an appropriate vertical height for a properly executed practice tackle.

During a properly executed practice tackle, the tackler's head 92 is directed laterally away from a center of the primary pad 14. The head 92 interfaces first with the apex 60. The tapering of the head directing portion 30 toward the enlarged base 64 forces the head 92 to move laterally left or right. Training the head 92 to move laterally during a tackle teaches the athlete 80 to avoid leading with their head 92.

The tackling training device 10 utilizes arm directing and head directing within a single training device 10. Other example pads may use one of these features.

During a tackling the forward facing area 36 may interface with areas of a tackler other than the chest, such as the shoulder, during training.

Figure 7:
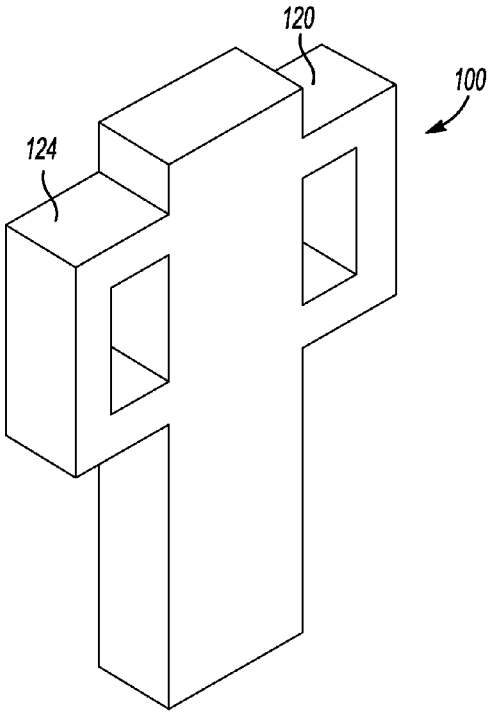
FIG. 7 shows a perspective view of another example tackling training device.
Figure 9:
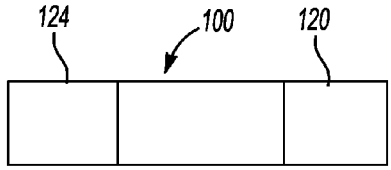
FIG. 9 shows a top view of the tackling training device of FIG. 7.
Figure 8:
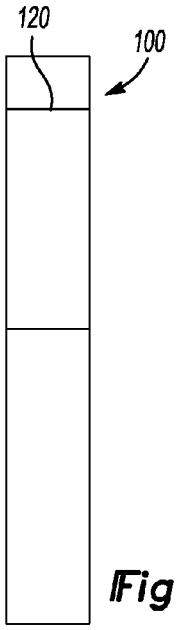
FIG. 8 shows a side view of the tackling training device of FIG. 7.

For example, referring to FIGS. 7-9, an example training device 100 utilizes arm directing portions 120 and 124, but does not utilize a head directing portion projecting forward from a primary pad.

Figure 10:
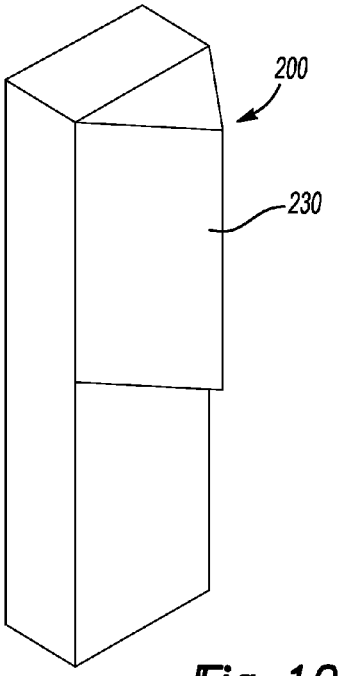
FIG. 10 illustrates yet another example tackling training device.
Figure 11:
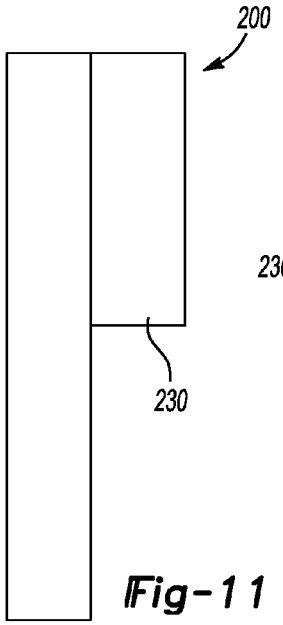
FIG. 11 shows a side view of the tackling training device of FIG. 10.
Figure 12:
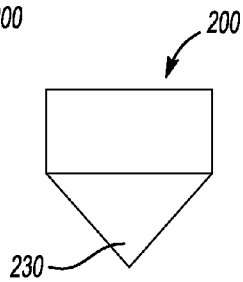
FIG. 12 shows a top view of the tackling training device of FIG. 10.

Referring now to FIGS. 10-12, yet another example training device 200 utilizes a head directing portion 230 but does not utilize a separate portion for directing a tackler's arms.

Features of the disclosed examples include a tackling device utilized to teach proper tackling techniques to avoid injury. In one example, the training device directs a tackler's head laterally and a tackler's arms inward to encourage the tackler to maintain a crouched position during a tackle without leading with their head.

We claim:

1. A tackling training device, comprising:

a primary pad;

a first arm directing portion extending from a first lateral side of the primary pad and providing a first opening to receive an arm of a tackler;

a second arm directing portion extending from an opposing, second lateral side of the primary pad and providing a second opening to receive another arm of the tackler; and a head directing portion at a vertical upper portion of the primary pad the head directing portion projecting from the primary pad toward the tackler, the head directing portion extending from a bottom side of the opening to and past an opposing, top side of the opening.

2. The device of claim 1, wherein the at least one arm directing portion comprises a first arm directing portion on a first lateral side of the primary pad and a second arm directing portion on an opposing, second lateral side of the primary pad.

3. The device of claim 1, wherein the head directing portion tapers from an apex to a laterally enlarged base, the apex configured to be positioned closer to the tackler than the laterally enlarged base.

4. The device of claim 3, wherein the apex is at a center of the primary pad.

5. The device of claim 1, wherein the at least one opening has a rectangular profile defined by padded portions about the perimeter of the rectangular profile.

6. The device of claim 1, wherein the at least one arm directing portion comprises a first arm directing portion and a second arm directing portion wherein the at least one opening has a height and a width, the height greater than the width.

7. The device of claim 1, wherein the primary pad includes a first side laterally spaced from a second side, wherein the first arm directing portion extends laterally outward from the first side and the second arm directing portion extends laterally outward from the second side.

8. The device of claim 1, wherein the primary pad has a rectangular profile.

9. The tackling training device of claim 1, wherein the primary pad is configured to be supported by a sled.

10. The tackling training device of claim 1, wherein the primary pad is configured to be hand-held.

11. The device of claim 1, wherein the entire perimeter of the opening is provided by a padded portion of the training device.

12. The device of claim 1, further comprising the head directing portion at a vertical upper portion of the primary pad, the head directing portion extending vertically above the at least one arm directing portion.

13. The device of claim 1, wherein the opening is continuous about the entire perimeter.

14. A tackling training device, comprising:

a primary pad;

a head directing portion extending from a forward facing side of the primary pad;

a first arm directing portion extending from a first lateral side of the primary pad and providing a first opening to receive an arm of a tackler; and a second arm directing portion extending from an opposing, second lateral side of the primary pad and providing a second opening to receive another arm of the tackler, the head directing portion extends vertically a first distance, the first and second arm directing portions extending vertically a second distance that is less than the first distance, wherein a vertical bottom of head directing portion is vertically aligned with vertical bottoms of the first and second arm directing portions, and a vertical top of the head directing portion is vertically above vertical tops of the first and second arm directing portions.

15. The tackling training device of claim 14, wherein an entire perimeter of the first opening is defined by the primary pad or the first arm directing portion.

16. The tackling training device of claim 14, wherein the first and second openings each have perimeters that are circumferentially continuous.

* * * * *